United States Patent [19]

Brendemuehl

[11] 4,176,775

[45] Dec. 4, 1979

[54] INHIBITING NOISE IN SHEET SPREADERS

[75] Inventor: Roger C. Brendemuehl, Beloit, Wis.

[73] Assignee: Beloit Corporation, Beloit, Wis.

[21] Appl. No.: 782,065

[22] Filed: Mar. 28, 1977

[51] Int. Cl.[2] ..... B65H 17/32

[52] U.S. Cl. ..... 226/7; 226/97; 226/197

[58] Field of Search ..... 226/7, 97, 197; 242/56.5

[56] References Cited

U.S. PATENT DOCUMENTS

| | | | |
|---|---|---|---|
| 3,122,295 | 2/1964 | Davison | 226/97 X |
| 3,216,638 | 11/1965 | Brickle | 226/7 X |
| 3,398,870 | 8/1968 | Mullan | 226/197 X |
| 3,463,377 | 8/1969 | Lucas | 226/197 |
| 3,498,515 | 3/1970 | Johnson | 226/197 X |
| 3,567,093 | 3/1971 | Johnson | 226/197 X |
| 3,719,316 | 3/1973 | Frye | 226/97 X |

*Primary Examiner*—Richard A. Schacher

*Attorney, Agent, or Firm*—Hill, Van Santen, Steadman, Chiara & Simpson

[57] ABSTRACT

Objectionable noise is inhibited in sheet spreaders of the type wherein strips of a slit traveling web are laterally separated by running the strips over spaced, bowed hollow spreader bars, frictional resistance being alleviated by floating the strips on a layer of air covering the areas of the bars wrapped by the strips. Tendency toward high frequency vibration and thus noise experienced in high speed operation is inhibited by ventilation in the tangency angles between the bars and the running strips.

22 Claims, 6 Drawing Figures

Fig. 1
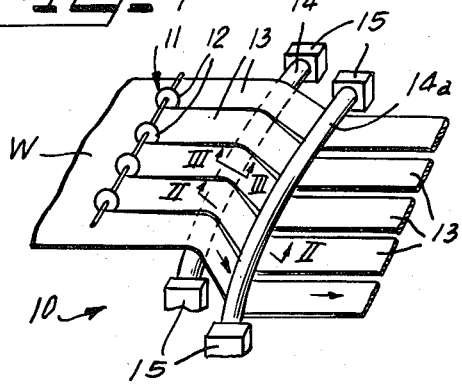
Fig. 2
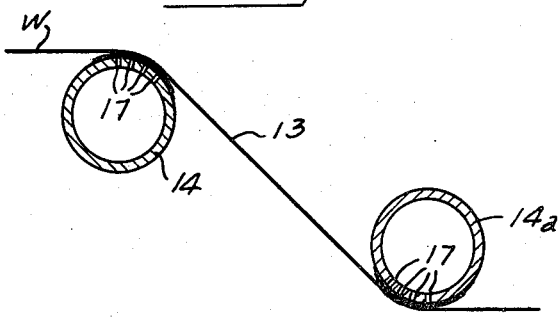
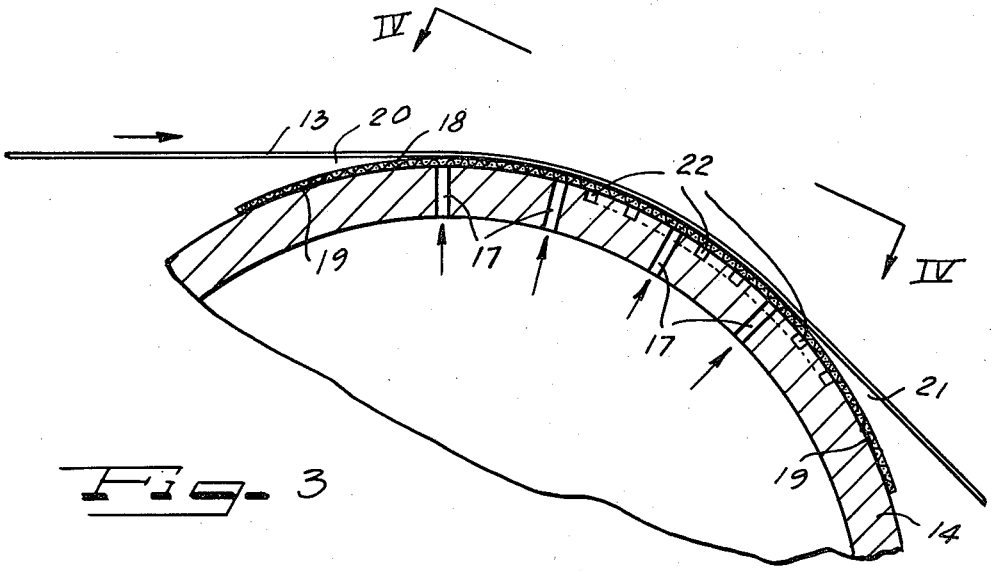
Fig. 3
Fig. 4
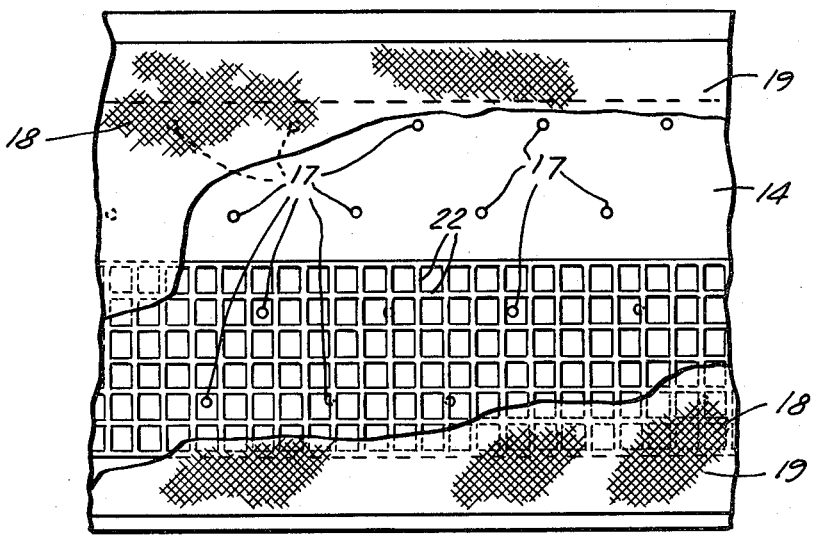

INHIBITING NOISE IN SHEET SPREADERS

This invention relates in general to strip or sheet spreaders of the bowed spreader bar type used in slitter and winder arrangements for laterally separating a plurality of immediately contiguous separate elongated strips of a just-slit running web, and is more particularly concerned with inhibiting noise that has been experienced with such spreaders.

In the manufacture of a paper or other elongated web, initially formed as a relatively wide sheet, the web is often wound onto a roll and later unwound for further preparation of the web by slitting it into a plurality of narrower strips for shipping, storing and use. Slitting is generally effected by passing the performed web through a slitter assembly, and finally to a winder in which the separate relatively narrow strips are wound upon a paper or a wooden core or steel pipe or plastic core.

A device especially suitable for separating the strips so that they can be conveniently rolled individually in high speed production is disclosed in U.S. Pat. No. 3,463,377. In that device the strips are run over a pair of complementary hollow spreader bars bowed in the upstream direction of movement of the strips. The bars are so disposed that the strips are guided in an angular separating path in successively wrapping arcuate areas of the bars. By adjustment of the bars, the amount of bow curvature, the horizontal relative position, and the spaced position of the bars and the tension applied to the strips can be controlled. In order to avoid undue friction between the strips and the spreader bars, the bars are perforated in the areas thereof opposed to the travelling strips to provide a strip-lifting anti-friction, lubricating air layer between the strips and the bar surfaces.

At high speed and thus increased sheet tension, an objectionable howling noise or sonic whistle has been experienced. The noise level has also been noted to increase when the air pressure in the lifting layer is increased. If the spreader bar spacing is increased, the noise level is reduced, but there is a practical limit on how far the tubes can be spaced apart. It has been determined that the objectionable noise level is produced by a substantially bow string vibration of the sheet strips especially where they stretch between the bars. The onrunning and offrunning portions of the strips produce a broader band noise which is not as objectionable as the noise produced by the portions of the strips stretched between the bars, but nevertheless add to the objectionable noise volume.

It is to the alleviation of the noise problems just mentioned that the present invention is directed.

I have discovered that the noise level in the operation of the sheet spreaders can be substantially inhibited by ventilating the tangency angle areas between the spreader bars and the running web strips.

Therefore it is an important feature of the present invention to provide a method of inhibiting noise in the operation of a sheet spreader of the type wherein just-slit web strips running at high speed are separated laterally by travelling in limited lapping relation across complementary spaced bowed separating bars supplied with strip-lifting anti-friction lubricating air layers between the bars and the strips, and comprising ventilating the tangency angle areas between the bars and the running strips, and thereby avoiding noise generating vibrations of the running strips.

According to other features of the invention, there are provided means for ventilating the tangency angle areas between the bars and the running strips whereby noise generating vibrations are avoided in the strips.

Other objects, features and advantages of the invention will be readily apparent from the following description of representative embodiments thereof, taken in conjunction with the accompanying drawings although variations and modifications may be effected without departing from the spirit and scope of the novel concepts embodied in the disclosure and in which:

FIG. 1 is a sheet spreader embodying features of the invention.

FIG. 2 is an enlarged sectional detail view taken substantially along the line II—II of FIG. 1.

FIG. 3 is a substantially enlarged fragmentary sectional detail view taken along the line III—III in FIG. 1.

FIG. 4 is a fragmentary plan detail view taken substantially in the plane of line IV—IV of FIG. 3.

Figure 5:
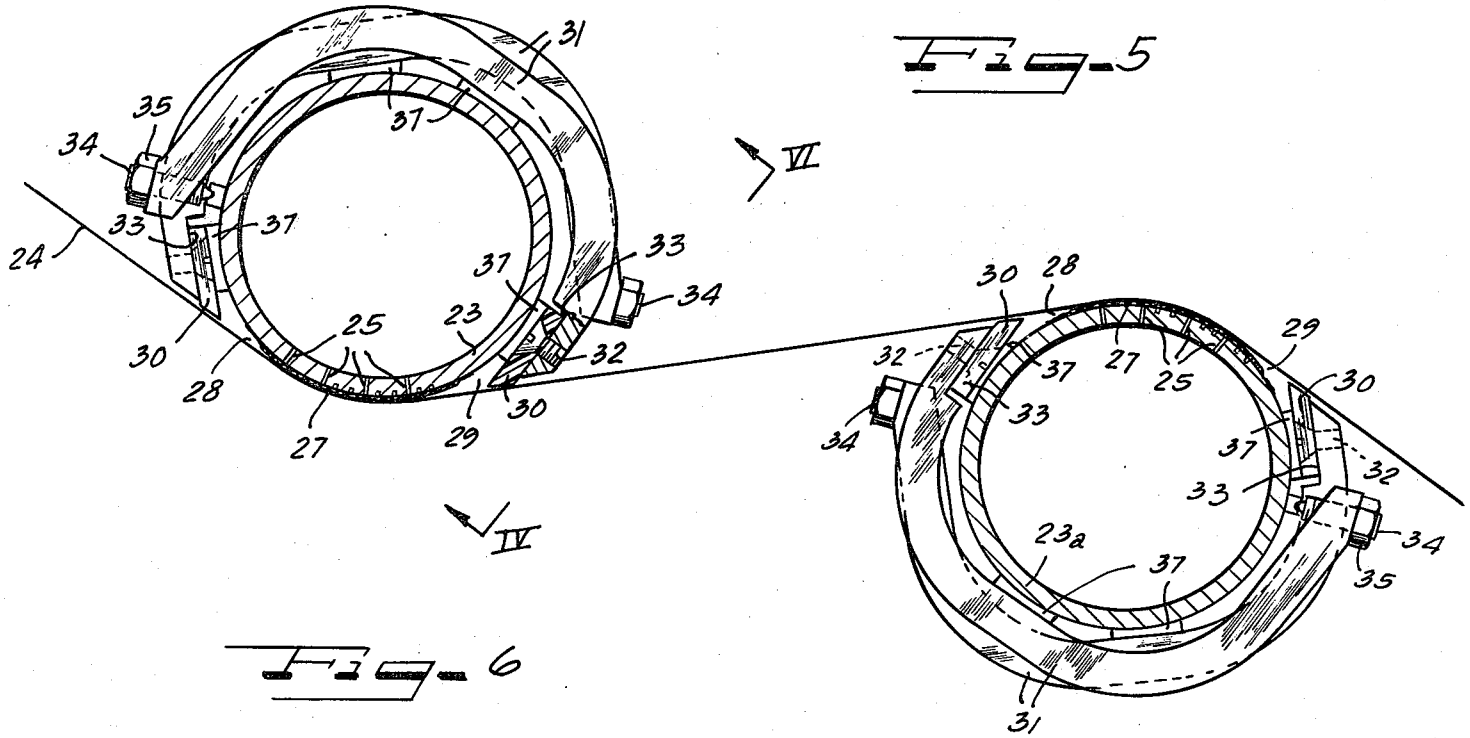
FIG. 5 is a schematic vertical sectional detail view showing a modification.

A sheet separator 10 (FIG. 1) embodying features of the invention is of the type disclosed in U.S. Pat. No. 3,463,377 which is embodied herein by reference to whatever extent necessary for complete disclosure in order to avoid repetitiousness. Suffice it to say that a preformed web W derived from a supply such as a roll of the web material is caused to travel at desired high speed through a slitter 11 so that slitter blades 12 divide the web longitudinally into a plurality of strips 13 of any preferred width. Following the slitter 11, the strips 13 pass through the separator or spreader 10 wherein the strips are separated laterally by travelling in limited wrapping relation across complementary spaced bowed separator bars 14 and **14*a*. From the separator 10, the laterally spaced strips 13** run parallel to each other to a winding station where they are wound onto winding rolls.

Each of the spreader bars 14 and **14*a* may be substantially identical in general construction. To this end each of the bars desirably comprises a tubular rigid member of bowed form and mounted non-rotatably but adjustably at each opposite end on supporting structure 15 with the bar 14 located to receive the just-slit strips 13 thereacross first whereafter the web strips pass across the underside of the bar 14*a* which is located in spaced relation downstream from the bar 14. Each of the bars 14 and 14*a* is bowed in the upstream direction and is properly adjusted so that as the web strips 13 wrap limited peripheral arcuate areas of the bars the bowed disposition of the bars effects the desired relative lateral separation of the strips. Although the bars 14 and 14*a* are supported non-rotatably, the connection thereof with the supporting structures 15 permits the bars to be adjusted horizontally or vertically or torsionally or longitudinally in order to attain optimum operating results. In order to eliminate mechanical friction between the web strips 13 and the opposed perimeters of the bars 14 and 14*a*, means are provided for supplying strip-lifting, anti-friction lubricating air layers between the bars and the strips. This is accomplished as best seen in FIGS. 2–4 by equipping the perimeter portions of the bars 14 and 14*a* wrapped by the strips 13 with ports 17 extending from the hollow interiors of the bars to the outer perimeters so that air under pressure suitably supplied to the interiors of the bars will immerge from the ports 17 and provide the strip-lifting air layers. In a desirable arrangement the ports 17 are disposed in a spaced staggered pattern throughout about a 45° segment of the respective hollow bar perimeter. While the air layer lifting, lubricating spacing of the rapidly travelling web strips 13 from the bar perimeters functions to excellent effect for the intended purpose, high frequency noise has been generated by reason of generally bow string vibrations occuring in especially the lengths of the strips 13 which are stretched between the separator bars 14 and 14***a*. Such vibrations are apparently induced by the drop-off or tension relaxation as the strips leave the air layer on which they ride as they wrap the respective bars.

According to the present invention the objectionable noise is substantially inhibited by ventilating the tangency angle areas between the spreader bars and the running strips, thereby avoiding noise generating vibrations in the running strips. In one desirable form as best visualized in FIGS. 3 and 4, the ventilating means comprise covering the flotation zone perimeter portions of the bars 14 which are perforated by the ports 17 with plastic screening 18. In each instance, the screen 18 is desirably of a length to cover the entire flotation zone and of a width to extend a substantial distance beyond into the tangency angle areas at each side of the zone. The longitudinal marginal portions of the screen 18 beyond the flotation zone are secured in suitable manner fixedly to the bar perimeter as by means of suitable bonding agent 19 which may comprise epoxy or the like. Screen material that has been found satisfactory is a woven plastic screen of the general type employed in fourdrinier wires used in papermaking and may have a mesh size of 54 to 70 perforations per square inch. An advantage of such plastic screen material, in addition to enhancing air layer distribution in the flotation zones on the bars, is that the foraminous structure and undulating surface and the limited contact protuberances over the surface of the screen opposing the web strips travelling thereacross minimizes frictional resistance during start-up or shut-down or where the air pressure is reduced or stopped or fails for any reason and the strips may make direct contact with the screen. This feature is especially advantageous where lighter weights of paper sheet are handled in the device.

Although the air distribution effect of the screen 18 permits some of the strip-lifting layer of air to ventilate the tangency angle area, identified at 20, between the spreader bar and the running strips 13, in each instance, as well as the tangency angle area, identified at 21, between the spreader bar and the running strips 13 at the off-running side of the flotation zone in each instance, improved results in noise inhibition are obtained where freer movement of ventilating air into the off-running tangency angle area 21 is provided for. For this purpose an array of grooves 22 is formed in the surface of the spreader bar in the off-running portion of the flotation zone under the screen 18. The grooves 22 may run circumferentially or longitudinally, or at any preferred angle, being shown as a grid of such grooves, and manufacturing convenience and economy will dictate the preferred or desired arrangement. In any event, a substantial on-running portion of the flotation zone surface of the spreader bar remains free from the ventilation grooves to assure maximum lifting or flotation action of the air layer in the ungrooved portion. Then as the strips 13 travel over the grooved off-running portion of the flotation zone, the lifting pressure of the air substantially follows the travelling strips and together with the additional air delivered through the ports 17 in the grooved portion of the flotation zone assures continuous floating support for the tensioned travelling strips 13. As best visualized in FIG. 3, the grooved area extends in the off-running direction beyond the ports 17 into the tangency angle area 21, thereby delivering into such tangency angle area a substantial volume of ventilating air which delays pressure decay and avoids sudden tension dropoff in the travelling strips 13 as they run away from the last of the pressure air ports 17 at the off-running side of the floatation zone. In other words, by ventilating the off-running tangency angle area 21 there is a gradual decay in lifting tensioning air pressure on the rapidly travelling web strip 13 so that noise generating vibrations in the running strips are avoided. Tests have shown that where the spreader bars have not been equipped with the noise inhibiting means, the dominant sheet vibration frequency as measured on a noise meter may range from 250 to 1000 Hz, depending upon the floatation air pressure and sheet tension. Identical noise meter tests where the spreader bars have been equipped with the noise inhibiting means of the present invention have shown that the noise producing vibrations in the travelling web strips were apparently entirely eliminated.

It will be understood, of course, that although the noise inhibiting means have been described primarily in connection with the separator bar 14, that the floatation zone of the bar 14*a* will be equipped with the same noise inhibiting means.

Figure 6:
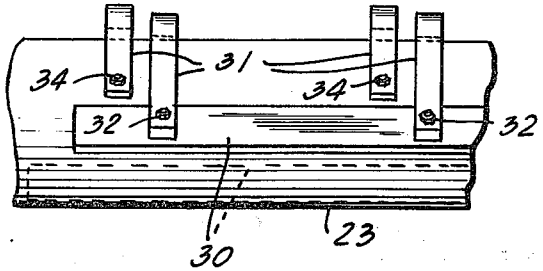
FIG. 6 is a fragmentary elevational detail view taken substantially in the plane of line VI—VI of FIG. 5.

In FIGS. 5 and 6 an arrangement is depicted in which noise inhibiting ventilation is adapted to be provided for existing sheet spreaders of the type having spreader bars equipped with flotation zones and wherein it would not be feasible to replace the bars with bars having ventilation grooves in the off-running sides of the flotation zones. Similarly as in the form of the invention already described, hollow spreader bars 23 and 23*a* are located relative to one another in suitably spaced relation and with their perimeters so oriented that just-slit web strips 24 are suitably laterally spread relative to one another by travelling successfully across limited arcuate portions of the perimeters of the bars. In this instance the strips 24 travel under the bar 23 and over the bar 23*a*. Each of the spreader bars 23 and 23*a* has in the strip-wrapped portion thereof a suitable array of perforations providing ports 25 through which air under pressure from the hollow interiors of the bars issues to provide a strip-lifting anti-friction lubricating air layer in what may be termed the flotation zone on that portion of each of the bars across which the strips travel in partially wrapping relation. For similar reasons as described in connection with FIGS. 1–4, respective foraminous covering material in the form of plastic screen 27 may be mounted over the flotation zone in each instance.

For assisting the plastic screen 27 in ventilating on-running tangency areas 28 and off-running tangency areas 29 between the strips 24 and the perimeters of the bars 23 and 23*a*, to avoid noise generating vibration in the running web strips 24, adaptor means are provided which will substantially trap and concentrate air escaping from the flotation zone in each instance to assure thorough ventilation of the tangency angle areas. In a desirable construction, such means comprise respective air barriers in the form of baffle bars 30 adapted to be mounted in position on the spreader bars and across the tangency angle areas by means of generally C-clamp brackets 31. For standardization each of the baffle bars 30 and mounting brackets 31 is identically constructed so that description of one will suffice for all of the others. Each of the baffle bars 30 may for convenience be in the form of a plurality of sections mounted end-to-end or, if preferred, a single bar, but in any event of a length about equal to the length of the associated flotation zone. In cross section each of the baffle bars 30 is flat and attached as by means of screws 32 to recessed seats 33 provided on a spaced series of the brackets 31 along the length of the baffle bar. While the brackets 31 may be formed from suitable metal, the baffle bars may be made from a suitable thermo-set rigid plastic material. Each of the brackets 31 wraps greater than 180° of the associated spreader bar and is equipped at its end opposite the baffle bar with securing means such as a large set screw 34 and a jam nut 35 whereby the set screw is driven to secure the bracket member in place and the jam nut holds the secured position. Retention of the silencer assembly in each instance is improved and machine vibrations damped by means of elastomer pads 37, interposed between the baffle bars 30 and at least one area of the bracket 31 in each instance, substantially as shown.

Mounting of each of the baffle bars 30 is generally tangent to the perimeter of the associated spreader bar to extend across the associated tangency angle area 28 or 29, as the case may be, at a distance from the associated flotation zone to provide a substantial pocket in the tangency angle area to, in effect, trap the pressure air from the flotation zone sufficiently to delay pressure decay for an interval which will at the on-running side of the flotation zone ease the high speed web strips to the flotation zone without noise generating vibration and, even more importantly, carry the web strips from the off-running side of the flotation zone without noise generating vibrations. By having the edges of the baffle bars 30 on chamfered angles generally parallel to the tensioned web strips 24 a fairly close but spaced relation of the edges of the baffle bars to the strips can be maintained, substantially as shown, to enhance the effectiveness of the baffle bars.

It will be understood that variations and modifications may be effected without departing from the spirit and scope of the novel concepts of this invention

I claim as my invention:

1. A method of inhibiting noise in the operation of a sheet spreader of the type wherein just-slit web strips running at high speed are separated laterally by travelling in limited wrapping relation across curvate flotation zones on complementary spaced spreader bars with respect to which the web strips approach and leave tangentially, so that there are tangency angle areas between the bars and the strips outside of the flotation zones, said flotation zones being supplied with strip-lifting antifriction lubricating air layers between the flotation zones and the strips in the flotation zones, said method comprising:

effecting air layer distribution in said flotation zones;

ventilating said tangency angle areas between the bars and the running strips by supplying to the tangency angle areas a sufficient volume of ventilating air for delaying pressure decay in said tangency angle areas;

and thereby avoiding sudden tension fluctuations in the running strips and thus inhibiting noise generating vibrations in the running strips.

2. A method according to claim 1, which comprises supplying the flotation zones of the bars with air under pressure through an array of ports in the flotation zone, and applying plastic screen over the flotation zones and extending beyond the flotation zones into the tangency angle areas.

3. A method according to claim 2, comprising enhancing movement of ventilating air through an array of grooves under the off-running side portions of the screens.

4. A method according to claim 1, including leading ventilating air from the flotation zones into the tangency angle areas.

5. A method according to claim 1, comprising substantially trapping air from the flotation zones in the tangency angle areas.

6. A method according to claim 1, comprising issuing air into the flotation zones through ports in the spreader bars, covering the flotation zones with porous screens, and mounting air barriers across said tangency angle areas and thereby restraining escape of air moving from the flotation zones into the tangency angle areas.

7. A sheet spreader having complementary spaced spreader bars having thereon curvate flotation zones across which just-slit web strips run at high speed in limited wrapping relation to the bars and are spread laterally, the web strips approaching and leaving said curvate flotation zones tangentially, so that there are tangency angle areas between the bars and the strips outside of the flotation zones, the bars having means for supplying the flotation zones with strip-lifting anti-friction lubricating air layers between said flotation zones and the strips, and comprising:

means for effecting air layer distribution in said flotation zones; and means for supplying to said tangency angle areas between the bars and the running strips a sufficient volume of ventilating air for delaying pressure decay in said tangency angle areas;

whereby to avoid sudden tension fluctuations in the running strips and thus to inhibit noise generating vibrations in the running strips.

8. A sheet spreader according to claim 7, wherein said flotation zones of the spreader bars have an array of ports in the flotation zone through which air under pressure is supplied to the flotation zone, and plastic screen over the flotation zones and extending beyond the flotation zones into the tangency angle areas.

9. A sheet spreader according to claim 8, comprising an array of grooves in said spreader bars under the off-running side portions of the screens.

10. A sheet spreader according to claim 7, including means for leading ventilating air from the flotation zones into the tangency angle areas.

11. A sheet spreader according to claim 7, comprising means for substantially trapping air from the flotation zones in the tangency angle areas.

12. A sheet spreader according to claim 7, wherein said spreader bars have ports in the flotation zones through which air is issued to the flotation zones, porous screens covering the flotation zones, and air barriers mounted across said tangency angle areas for restraining escape of air moving from the flotation zones into the tangency angle areas.

13. A sheet spreader according to claim 12, wherein said air barriers comprise barrier bars, and means for mounting the barrier bars on the spreader bars.

14. A sheet spreader according to claim 12, wherein said air barriers comprise substantially flat bars extending longitudinally along the spreader bars and projecting substantially tangentially relative to the spreader bars into and across the tangency angle areas.

15. A method of inhibiting noise in the operation of a sheet spreader of the type wherein just-slit web strips running at high speed are separated laterally by travelling in limited wrapping relation across curvate floation zone on complementary spaced spreader bars with respect to which the web strips approach and leave tangentially, so that there are tangency angle areas between the bars and the strips outside of the flotation zones, said flotation zones being supplied with strip-lifting antifriction lubricating air layers between the flotation zones and the strips in the flotation zones, the method comprising:

supplying said flotation zones of the bars with air under pressure through an array of ports in said flotation zones;

applying plastic screens over said flotation zones and extending beyond said flotation zones into said tangency angle areas;

thus ventilating said tangency angle areas;

and thereby avoiding noise generating vibrations in said running strips.

16. A method according to claim 15, comprising enhancing movement of ventilating air through an array of grooves under the off-running side portions of said screens.

17. A method of inhibiting noise in the operation of a sheet spreader of the type wherein just-slit web strips running at high speed are separated laterally by travelling in limited wrapping relation across curvate flotation zones on complementary spaced spreader bars with respect to which the web strips approach and leave tangentially, so that there are tangency angle areas between the bars and strips outside of the flotation zones, said flotation zones being supplied with strip-lifting antifriction lubricating air layers between the flotation zones and the strips in the flotation zones, the method comprising:

issuing air into said flotation zones through ports in said spreader bars;

covering said flotation zones with porous screens;

mounting air barriers across said tangency angle areas and thereby restraining escape of air moving from said flotation zones into said tangency angle areas;

thus ventilating said tangency angle areas;

and thereby avoiding noise generating vibrations in said running strips.

18. A sheet spreader having complementary spaced spreader bars having thereon curvate flotation zones across which just-slit web strips run at high speed in limited wrapping relation to the bars and are spread laterally, the web strips approaching and leaving said curvate flotation zones tangentially, so that there are tangency angle areas between the bars and the strips outside of the flotation zones, the bars having means for supplying the flotation zones with strip-lifting anti-friction lubricating air layers between said flotation zones and the strips, and comprising:

said flotation zones of said spreader bars having an array of ports through which air under pressure is supplied to said flotation zones;

and means for ventilating said tangency angle areas comprising plastic screens over said flotation zones and extending beyond the flotation zones into said tangency angle areas;

and thereby avoiding noise generating vibrations in said running strips.

19. A sheet spreader according to claim 18, comprising an array of grooves in said spreader bars under the off-running side portions of said screens.

20. A sheet spreader having complementary spaced spreader bars having thereon curvate flotation zones across which just-slit web strips run at high speed in limited wrapping relation to the bars and are spread laterally, the web strips approaching and leaving said curvate flotation zones tangentially, so that there are tangency angle areas between the bars and the strips outside of the flotation zones, the bars having means for supplying the flotation zones with strip-lifting anti-friction lubricating air layers between said flotation zones and the strips, and comprising:

said spreader bars have ports in said flotation zones through which air is issued to said flotation zones;

porous screens covering said flotation zones;

and means for ventilating said tangency angle areas comprising air barriers mounted across said tangency angle areas for restraining escape of air moving from said flotation zones into said tangency angle areas;

whereby to avoid noise generating vibrations in said running strips and thereby inhibiting noise in the operation of the sheet spreader.

21. A method of inhibiting noise in the operation of a sheet spreader of the type wherein just-slit web strips running at high speed are separated laterally by travelling in limited wrapping relation across curvate flotation zones on complementary spaced spreader bars with respect to which the web strips approach and leave tangentially, so that there are tangency angle areas between the bars and the strips outside of the flotation zones, said flotation zones being supplied with strip-lifting antifriction lubricating air layers between the flotation zones and the strips in the flotation zones, said method comprising:

ventilating said tangency angle areas between said bars and said running strips by substantially trapping in said tangency angle areas a sufficient volume of ventilating air from said flotation zones for delaying pressure decay in said tangency angle areas;

and thereby avoiding sudden tension fluctuations in the running strips and thus inhibiting noise generating vibrations in the running strips.

22. A sheet spreader having complementary spaced spreader bars having thereon curvate flotation zones across which just-slit web strips run at high speed in limited wrapping relation to the bars and are spaced laterally, the web strips approaching and leaving said curvature flotation zones tangentially, so that there are tangency angle areas between the bars and the strips outside of the flotation zones, the bars having means for supplying the flotation zones with strip-lifting anti-friction lubricating air layers between said flotation zones and the strips, and comprising:

means for supplying from said flotation zone to said tangency angle areas a sufficient volume of ventilating air for delaying pressure decay in said tangency angle areas;

and means for substantially trapping in said tangency angle areas air supplied by said supplying means;

whereby to avoid sudden tension fluctuations in the running strips and thus to inhibit noise generating vibrations in the running strips.

* * * * *